United States Patent [19]

Wüst

[11] 3,959,965

[45] June 1, 1976

[54] METHOD AND APPARATUS FOR WELDING A LINK CHAIN

[75] Inventor: Toni Wüst, Cologne, Germany

[73] Assignee: Meyer, Roth & Pastor Maschinenfabrik GmbH, Cologne, Germany

[22] Filed: Feb. 20, 1975

[21] Appl. No.: 551,323

[30] Foreign Application Priority Data

Feb. 25, 1974 Germany ..... 2408930

[52] U.S. Cl. ..... 59/31

[51] Int. Cl.[2] ..... B21L 3/00

[58] Field of Search ..... 59/31, 1, 3, 22, 25, 59/32, 33, 34, 35, 26

[56] References Cited

UNITED STATES PATENTS

| | | | |
|---|---|---|---|
| 1,023,127 | 4/1912 | Ryan | 59/31 |
| 2,684,422 | 7/1954 | Esser | 59/31 |
| 3,701,253 | 10/1972 | Wüst | 59/31 |

FOREIGN PATENTS OR APPLICATIONS

| | | | |
|---|---|---|---|
| 1,185,511 | 2/1959 | France | 59/22 |
| 1,340,047 | 9/1963 | France | 59/22 |
| 2,036,244 | 12/1970 | France | 59/31 |
| 1,470,257 | 1/1967 | France | 59/31 |
| 2,019,586 | 4/1970 | Germany | 59/31 |

*Primary Examiner*—C. W. Lanham
*Assistant Examiner*—Gene P. Crosby
*Attorney, Agent, or Firm*—Spencer & Kaye

[57] ABSTRACT

For welding, in the course of a single pass, a link chain of indeterminate length formed of C-shaped, serially interconnected, alternating first and second links, the chain is guided, in a welding machine, through a first welding position, in the zone of which the first links have an edgewise upright orientation and the second links have a flat-lying orientation. In the first welding position the first links are welded. Then the partially welded chain is guided to and through a second welding position in such a manner that in the zone of the second welding position, the second links have an edgewise upright orientation and the first links have a flat-lying orientation. In the second welding position the welding of the chain is completed by welding the second links. Subsequent to the welding of each first or second link, the just-welded link is advanced for bringing the successive first or second link into the first or second welding position, respectively..

7 Claims, 5 Drawing Figures

METHOD AND APPARATUS FOR WELDING A LINK CHAIN

BACKGROUND OF THE INVENTION

This invention relates to a method and an apparatus for electrically welding a link chain formed of prebent, C-shaped, serially interconnected chain links. In a link chain of this kind the joints of consecutive links are offset by 90° with respect to one another.

In known processes of the afore-outlined type, the interconnected, prebent links of the chain are advanced in the chain link welding machine in such a manner that each time the link to be welded is positioned in the welding saddle of the chain link welding machine in an edgewise upright orientation with the still unwelded joint at the top. In this manner only every other chain link can be welded, so that for completing the welding, the chain has to be passed twice through the welding machine. Such a procedure permits only a limited reduction of the time necessary for making the chains.

Since during one pass of the chain through the welding machine only every other link is welded, the intermittent chain feed must be relatively large. The speed of the chain feed, however, cannot be arbitrarily increased due to the requirement of an exact positioning of the chain link to be welded. Because of the repositioning and two-time threading of the chain, there is required a relatively large work and transportation input. Further, welding machines which operate according to this known process cannot be arranged to operate synchronously with an upstream-connected chain link bending machine.

SUMMARY OF THE INVENTION

It is therefore an object of the invention to provide an improved method and apparatus of the above-outlined type with which the complete welding of a link chain can be effected during a single pass of the chain through the welding machine.

This object and others to become apparent as the specification progresses, are accomplished by the invention, according to which, briefly stated, the chain formed of C-shaped, serially interconnected, alternating first and second links (hereinafter designated as "*a*-links and "*b*-links", respectively), is guided to and through a first welding position, in the zone of which the first links have an edgewise upright orientation and the second links have a flat-lying orientation. In the first welding position the first links are welded. Then the partially welded chain is guided to and through a second welding position in such a manner that in the zone of the second welding position, the second links have an edgewise upright orientation and the first links have a flat-lying orientation. In the second welding position, the welding of the chain is completed by welding the second links. Subsequent to the welding of each first or second link, the just-welded link is advanced for bringing the successive first or second link into the first or second welding position, respectively.

The above-outlined method according to the invention makes possible not only the manufacture of a fully welded link chain during a single pass through the welding machine, but also permits a significant increase in the chain manufacturing speeds, because during the period one chain link is welded, another chain link can already be advanced into the welding position without the necessity of increasing the chain feeding speed. Thus, there may be effected a relatively slow feeding step with all the advantages of an exact positioning of the chain link to be welded.

Since, because of the irregularities and/or unilateral wear of the tools in the chain link bending machine each chain link has, particularly in the zone of the joint (that is, the location to be welded), an embossed unilateral orientation which remains constant for a prolonged manufacturing period and since in the bending machine the links are bent and simultaneously hooked alternately from the left and from the right into the running chain, such an orientation changes sides from link to link. If now one chain link has to be welded after the other, the asymmetrical zone in the shape of the chain links arrives into the welding position once from the left and once from the right. In order to circumvent this problem, according to the known welding process outlined above, the chain was reversed upon completion of the first pass so that in the second pass the chain was advanced end first. With the method according to the invention it is possible to compensate for this asymmetry in the welding position. Such compensation may be effected by providing two serially arranged welding stations, the electrodes of which are adjusted in such a manner as to take into account the lateral position of the above-explained asymmetry of the chain links. According to a preferred embodiment of the method according to the invention, however, the chain is guided in an arc backwardly from a first welding position (where the upright positioned *a*-links are welded) to a second welding position (where the upright positioned *b*-links are welded) and that at least in the zone of the welding positions the two juxtapositioned, oppositely oriented chain portions are moved with respect to the welding positions transversely to their direction of feed into and out of a single welding station. By virtue of guiding the chain to reverse its direction as outlined above, each *a*-link as well as each *b*-link arrives with the same orientation into the welding position, so that for each welding step practically constant welding conditions are given. The result is that either the quality of the chain may be further improved or, without adversely affecting the chain quality, the requirements set for the bending quality may be lowered.

The invention further relates to a chain link welding machine for performing the above-outlined method. The chain link welding machine has at least one upsetting tool assembly, one welding electrode assembly as well as means for advancing the chain. According to the invention, the welding machine comprises two saddles for positioning the chain link to be welded; each saddle has lateral arcuate chain guide ramps. Between the two saddles there is provided, for the partially welded chain portion, a guide means for effecting a 90° turn of the chain about its longitudinal axis.

According to a particularly advantageous feature of the invention, the two saddles are, with respect to the run-in direction of the chain, arranged in a juxtapositioned relationship. The guide means for the partially welded chain portion interconnects the saddles in an arcuate manner. By virtue of this arrangement it is possible to effect in a simple manner the return feed of the chain while simultaneously twisting the same by 90°. While by virtue of the two separate saddles, two separate welding positions are provided, it is feasible to operate with a sole welding mechanism by arranging the welding electrode assembly and the upsetting tool assembly shiftably between the two saddles.

It is a further feature of the invention to support the two saddles in such a manner that they are movable transversely to the direction of the chain feed. By virtue of this feature the alternating welding of the chain links may be carried out in a significantly simplified manner, since the welding electrodes, the upsetting tools and the de-flashing device of a single welding station may be supported in a stationary manner and it is only the saddles which, possibly together with associated accessories, have to be shifted. For this purpose the saddles may be mounted on a common carriage provided with a drive to bring the saddles into the welding station. It is particularly expedient to connect each saddle with its own, controllable drive mechanism. By virtue of such an arrangement a significant reduction of the manufacturing times is possible, since subsequent to positioning on the saddle the chain link to be welded, the saddle can be brought into the welding position, even while the welding step involving the other chain link is still in its terminal phase. Thus, the desired increase of the manufacturing speed may be achieved without a substantial increase of the traveling speeds of the individually moving components of the welding machine.

It is a further feature of the invention to associate each saddle with a chain feeding clamp each having a jaw provided with its own controllable drive mechanism. In this manner a significant improvement can be achieved in the coordination of the individual movements with respect to one another.

According to a further feature of the invention, the chain feeding clamps are each supported on the associated saddle structure and are coupled with a common reversible drive shaft to perform an intermittent conveying step. In this manner the problems related to the drive of the conveying clamps is resolved in a simple manner, since by effecting a back-and-forth oscillation of the drive shaft with a simultaneous corresponding control for opening or closing the clamp jaw on the one saddle, one chain portion is advanced by one link whereas at the same time the conveying clamp associated with the other saddle moves, with an open jaw, backwardly with respect to the direction of advance of the other chain portion. Such backward motion does not disturb the setting of the chain link just being welded, since this chain link is firmly held by the upsetting tools.

According to a further feature of the invention, the saddles and the drive shaft are designed to be relatively movable with respect to one another. The drive shaft may simultaneously serve for guiding the saddle assembly. According to the invention it is further advantageous to connect the drive means of each clamp jaw with a control mechanism activated by the drive shaft.

It is a further feature of the invention to provide the arcuate chain guiding ramps with at least a portion (upper portion) which may be lowered and raised with respect to the associated saddle. In this manner, the support of the movably designed saddles is significantly simplified, since the saddles may be shifted back and forth on a stationary guiding bed fixedly attached to the machine frame. At the same time, the forces exerted during the welding process on the saddle by the upsetting tools and the electrodes can be absorbed by the guiding bed.

DESCRIPTION OF THE PREFERRED EMBODIMENTS

Turning now to the Figures, in a machine frame, not shown, there is stationarily supported in a known manner an electrode set 1, upsetting tools 2 as well as a de-flashing device 3. The electrodes, the upsetting tools and the de-flashing device are each connected with conventional drive means (not shown) to move them in a coordinated manner towards and away from a chain link to be welded.

Figure 1:
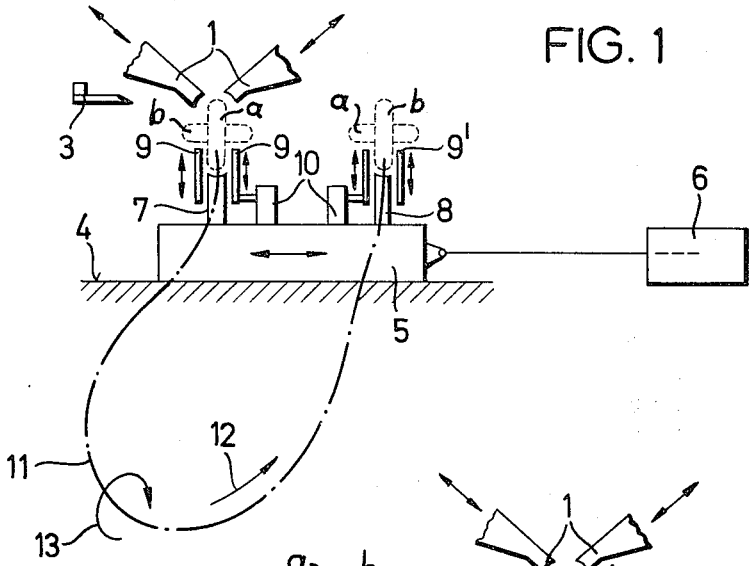
FIG. 1 is a schematic front elevational view of a preferred embodiment of the invention.

Particularly referring now to FIG. 1, underneath the welding electrodes 1 there is situated a guiding surface 4 on which there is supported a carriage 5. The latter is, at one end, connected with a drive mechanism 6 which may be of hydraulic or mechanical design and which, for example by means of a cam disc, activates a crank mechanism or similar device for moving the carriage 5 back and forth. On the carriage 5 there are secured two saddles 7 and 8. Expediently, the upwardly concave seating surface of each saddle is somewhat narrower than the wire diameter of the chain link, so that the seating surface of the saddle is fully covered when the chain link is positioned therein. As a result, no foreign particles, for example weld beads, may adhere on the seating surfaces of the saddles.

On both sides of the saddles 7 and 8 there are arranged separate arcuate chain guiding ramps 9 and 9′, respectively, which may be vertically raised or lowered by separate drive means 10. With the aid of these guide ramps the chain link to be welded is maintained in an edgewise upright position, whereas the two adjoining, flat-lying chain links in front of and behind the upright link, engage the guide ramps with the two link legs. It is thus seen that in the zone of the saddle 7 the *a*-links have an edgewise upright orientation, while the *b*-links lie flat and are supported by the ramps 9.

Between the saddle 7 and the saddle 8 there is provided a guide means 11 which is symbolically illustrated with dash-dot lines and with which the chain is guided in the direction of arrow 12 from the saddle 7 towards the saddle 8. This guide means 11 (for example, a trough-like structure) is designed in such a manner that the chain portion advanced therein is rotated by 90° about the longitudinal axis of the chain as indicated by the arrow 13. Thus, in the zone of the saddle 8, the *b*-links have an edgewise upright orientation, while the *a*-links lie flat and are supported by the ramps 9′.

The method practiced by the apparatus illustrated in FIG. 1 will now be described.

The *a*-link positioned upright on the saddle 7 between the two arcuate guide ramps 9 and beneath the electrodes 1 is laterally grasped at both ends by the upsetting tools (not shown in FIG. 1) and firmly maintained on the saddle 7. Thereafter, by means of the drive mechanism 10, the guide ramps 9 associated with the saddle 7 are lowered, the electrodes 1 are brought into an operative position and the welding current is passed therethrough. At the same time, by means of the chain feeding mechanism (not shown in FIG. 1) a *b*-links which earlier was lying flat on the two guide ramps 9 of the saddle 7 and has been subsequently rotated by the guide 11 to assume an upright position, is drawn onto the saddle 8 and positioned with respect to the electrodes 1. Upon completion of the welding of the *a*-link performed at the saddle 7, the guide ramps 9 are raised, the electrodes 1 and the upsetting tools 2 are withdrawn and then the carriage 5 is, by means of the drive mechanism 6, displaced transversely to the traveling direction of the chain under the electrode. Now the welding of the *b*-link is performed on the saddle 8, while simultaneously, at the saddle 7, a new *a*-link is brought into position by the chain feeding mechanism.

Figure 2:
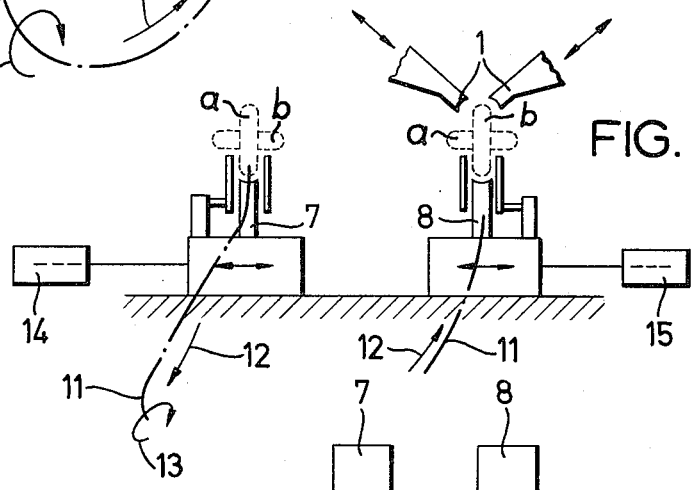
FIG. 2 is a schematic front elevational view of another preferred embodiment of the invention.

Turning now to FIG. 2, there is illustrated another embodiment of the chain link welding machine designed according to the invention. In this instance, the saddles 7 and 8 are separately supported and each is provided with its own guide means 14, 15, respectively. In this manner it is possible to move one saddle close to the welding station even before the completion of the welding process at the other saddle. Thus, while an *a*-link is still maintained in the saddle 7 and, for example while the de-flashing step involving that link is still in progress, the saddle 8, with the upright positioned *b*-link, may be moved close to the welding station. Thus, subsequent to the withdrawal of the upsetting tools and the electrodes, the new link (a b-link) to be welded may immediately be brought into the welding station and the upsetting tools as well as the electrodes may immediately be moved into their operative position. The saddle 7, together with the finished welded *a*-link, is moved laterally by actuating the drive mechanism 14.

Figure 2A:
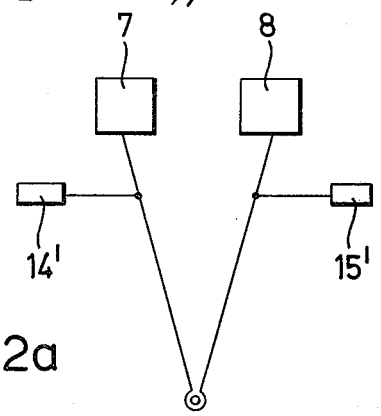
FIG. 2*a* is a schematic view of another structure of the embodiment according to FIG. 2.

FIG. 2*a* illustrates an embodiment with saddles 7 and 8 separately supported and each provided with its own guide means 14′, 15′, respectively. The saddles are guided, instead of a carriage as shown in FIGS. 1 and 2, by journalled reds, which are connected with the guide means 14′, 15′, respectively.

Figure 3:
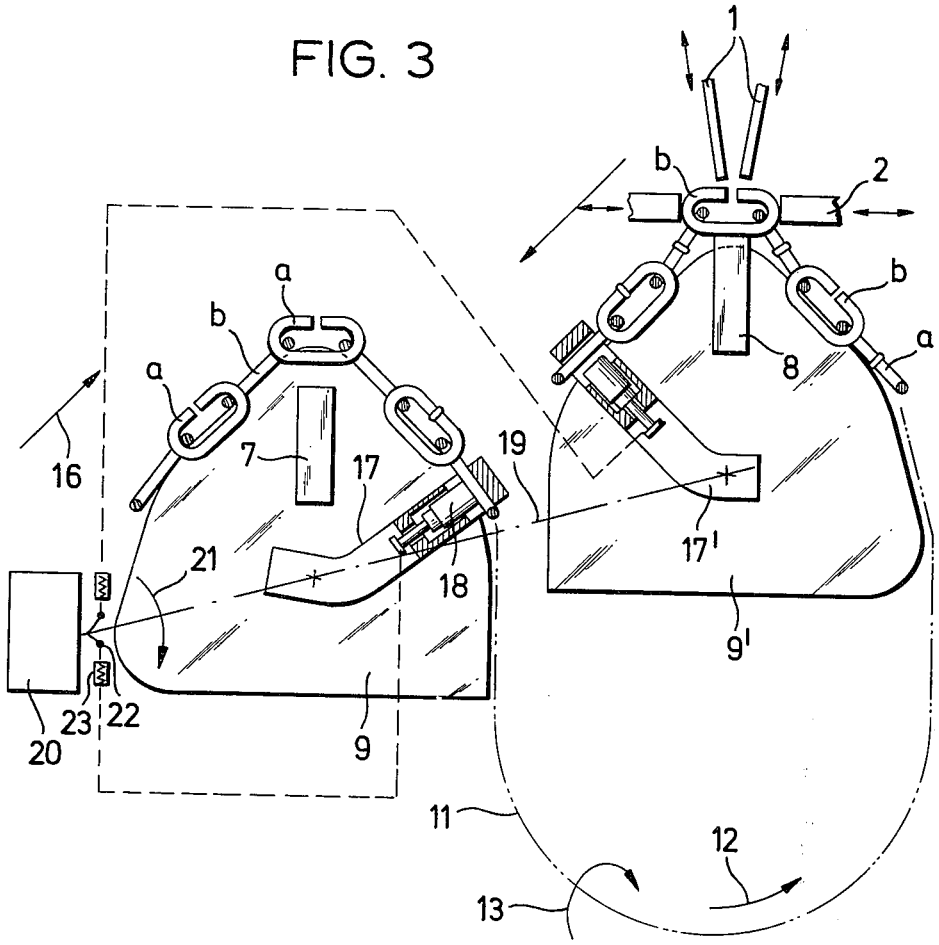
FIG. 3 is a schematic side elevational, partially sectional view of a detail of the embodiments of FIGS. 1 and 2.

The preferred operational sequence and cycle of the method according to the invention may be clearly followed from the simplified, schematic side elevational view of FIG. 3. The bent, unwelded chain arriving, for example, from a bending machine, first runs onto the guide ramps 9 of the saddle 7. As before, the links positioned edgewise upright between the two arcuate guide ramps 9 are designated with *a* and are thus the a-links, while the links which lie flat on the two guide ramps 9 are designated with *b* and are the *b*-links. Both the *a*-links and the *b*-links are in an unwelded state in the inlet zone designated with the arrow 16.

After the welding of an *a*-link is completed in the zone of the saddle 7, a pivotally supported feeding clamp 17 pulls the chain through a distance corresponding to the length of two links, so that the consecutive *a*-link is brought into the welding position on the saddle 7. The clamp jaw 18 is provided, in a manner known by itself, with its own controllable drive mechanism by means of which, during each feeding step, it grasps a flat-lying *b*-link. During each return swing, the clamp 16, with its jaw 18 open, is guided over a welded *a*-link for the purpose of grasping the consecutive *b*-link. The chain advances in the schematically illustrated guiding mechanism 11 which causes it to turn 90° in the direction of the arrow 13 and is fed onto the guide ramps 9′ of the saddle 8. By virtue of the 90° turn, the *b*-links will stand upright on the guide ramps 9′, whereas the *a*-links, already welded at the saddle 7, will be lying flat against guide ramps 9′ of the saddle 8. Thereafter, the welding of the *b*-links is effected in the zone of the saddle 8. The saddle 8 is, similar to the saddle 7, associated with a conveying clamp 17′, having the same structural characteristics as the clamp 17 associated with the saddle 7.

In the embodiment illustrated in FIG. 3, the feeding clamps 17 and 17′ are supported on a common drive shaft 19 (symbolically shown by a straight dash-dot line) which, at one end, is operatively coupled with a controllable drive mechanism symbolically illustrated at 20. By means of this drive mechanism, the shaft 19 can be oscillated back and forth as indicated by the arrow 21. By means of, for example, switch cams 22 which are affixed to the shaft 19 and which cooperate with respective switch devices 23, the drive mechanism of the conveying clamp 17 or 17′ may be alternately actuated in such a manner that upon movement of the shaft 19 in the clockwise direction, the clamp 17 is closed while the conveyor clamp 17′ is opened and conversely. The conveying clamps are rigidly supported on the drive shaft 19 with respect to rotation, while they are axially shiftably attached to the drive shaft 19, so that the entire saddle assembly (including the saddle and the guide ramps) and the clamp pivotally attached thereto, may be shifted on the drive shaft 19 by means of the corresponding drive mechanisms for the associated saddles.

As it may also be observed in FIG. 3, the guide ramps are, with respect to their associated saddles, designed to be vertically movable, whereby the drive means ensures that during the chain feeding step the guide ramps are in their raised position as shown for the saddle 7. At the same time, for the welding position, the guiding ramps are lowered, while the *b*-link to be welded is firmly positioned on the saddle 8 by the upsetting tools 2. Instead of lowering the entire guide ramps, it is advantageous to so design the latter that only their upper arcuate portion, which spans approximately 3–5 chain links, is vertically movable, whereas the other ramp portions remain in their fixed position.

Figure 3A:
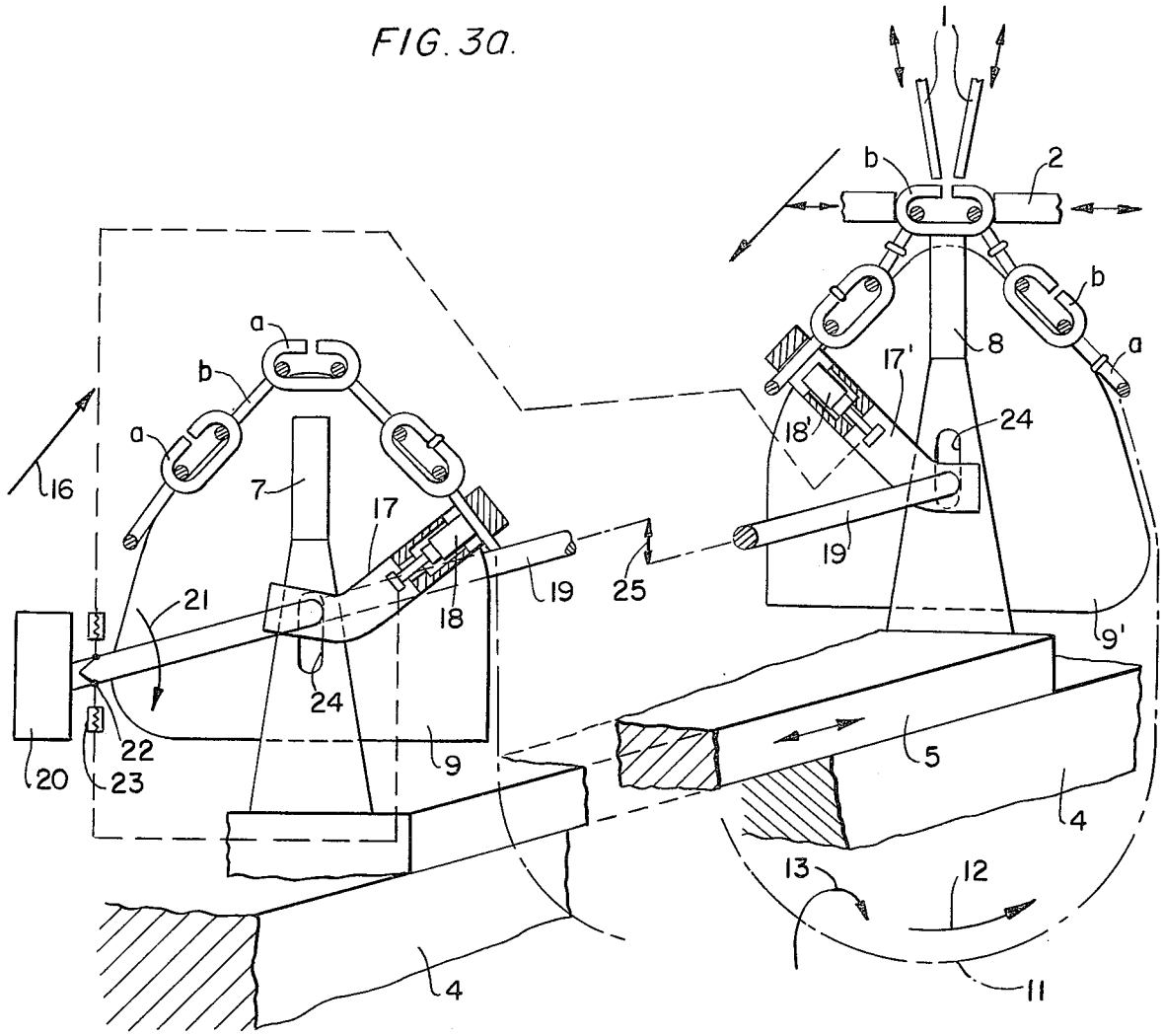
FIG. 3*a* is a view similar to FIG. 3, including additional details.

Within each saddle assembly, the relative position between the shaft, the conveying clamp, the saddle and the ramp in the upper and the lower position of the ramp can be particularly well seen in FIG. 3*a*. During operation of the apparatus, the vertical motions of the ramps 9 and 9′ are synchronous, that is, they are simultaneously either in their lower position or in their upper position. For purposes of simplified illustration, however, in the lefthand saddle assembly which includes the saddle 7 and the ramp 9, the ramp 9 is shown in its upper position, whereas in the righthand saddle assembly which includes the saddle 8 and the ramp 9′, the ramp 9′ is shown in its lower position. It is further seen that the saddles 7 and 8 do not move in the vertical direction; they are affixed to the carriage 5 which executes only a substantially horizontal motion on the guiding surface 4.

To ensure a disturbance-free guidance of the chain on the ramps, it is expedient that the clamps 17,17′ move in unison with their associated ramps 9,9′, respectively, during the vertical displacement of the latter. Since, in this embodiment, the clamps 17,17' are rotationally rigidly attached to the shaft 19, the shaft 19 also moves vertically in unison with the clamps 17,17'. Since further, the saddles 7 and 8 do not move vertically and the shaft 19 passes through the saddles, there is provided, in each saddle, a vertically extending slot 24 through which the shaft 19 passes.

For the phase when the chain is advanced with respect to the saddle assemblies, the ramps 9 and 9' are moved into their upper position, together with the shaft 19 and the associated clamps 17 and 17', respectively. In this upper position the shaft 19 extends at the upper end of the slots 24 as it may be observed in the lefthand saddle assembly.

For the welding phase, the shaft 19, the saddles 9 and 9' as well as the clamps 17 and 17' move into their lower position. The vertical displacement of the shaft 19 is indicated at 25. In this lower position, the shaft 19 extends at the lower end of the slots 24 as it may be observed in the righthand saddle assembly.

The guide mechanism 11 may be a twisted guide trough connecting the two saddles 7 and 8. It is particularly advantageous, as it may be observed in FIG. 3, to effect guidance of the chain only along the run-off side of the guide ramps 9 at the saddle 7 and along the run-on side of the guide ramps 9' at the saddle 8, while inbetween the chain portion is freely suspended. In this case the rotation of the chain by 90° is effected in the zone of the run-on side of the guide ramps 9'. For this purpose, one guide ramp 9' in the run-on zone is lying somewhat lower than the other guide ramp 9' and only gradually raises to the same height.

It is particularly advantageous to provide at the saddle 7 for the welding of the *a*-links, a device for generating an electromagnetic short circuit which affects the chain link to be welded, at the side of the still unwelded chain portion.

The purpose of this arrangement is to compensate for the asymmetry of the magnetic flux in the chain generated by the welding circuit; the asymmetry being caused by the fact that at the one side of that chain link which is being welded, all the chain links have a joint with an air gap, whereas on the other side of that link no air gap exists in every other link.

It will be understood that the above description of the present invention is susceptible to various modifications, changes and adaptations, and the same are intended to be comprehended within the meaning and range of equivalents of the appended claims.

I claim:

1. A method of welding a link chain of indeterminate length formed of C-shaped, jointed, serially interconnected, alternating first and second links, comprising the following steps for completing the welding of the chain during a single pass:

a. guiding said chain to and through a first welding position;

b. orienting the first and the second chain links in the zone of said first welding position to assume, respectively, an edgewise upright and a flat-lying orientation;

c. successively welding the joint of said first links held in said first welding position;

d. subsequent to the welding of a first link held in said first welding position, advancing the just-welded first link to bring the successive first link into the first welding position;

e. guiding said chain from said first welding position in an arc in a reverse direction to a second welding position for obtaining two juxtapositioned, oppositely oriented chain portions;

f. orienting the first and the second chain links in the zone of said second welding position to assume, respectively, a flat-lying and an edgewise upright orientation;

g. alternately with step (c), successively welding the joint of said second links held in said second welding position;

h. subsequent to the welding of a second link held in said second welding position, advancing the just-welded second link to bring the successive second link into the second welding position; and i. between two consecutive welding steps, displacing said chain portions transversely to the direction of chain advance for alternately bringing said first and second chain links in a sole welding station where steps (c) and (g) are performed.

2. In a chain welding machine for welding a link chain of indeterminate length formed of C-shaped, jointed, serially interconnected, alternating first and second links; the machine including first chain link supporting means for holding, in succession, each first link of the link chain in an edgewise upright orientation for welding; second chain link supporting means for holding, in succession, each second link of the link chain in an edgewise upright orientation for welding; the second chain link supporting means being arranged downstream of the first chain link supporting means respective the direction of advance of the link chain through the welding machine; the improvement comprising:

a. a sole chain link welding station including upsetting means and electrode means for engaging and welding a chain link of the link chain;

b. shifting means for alternately moving said first and said second chain link supporting means into said sole chain link welding station for alternately introducing thereinto said first and second chain links held by the respective first and second chain link supporting means; and c. chain advancing means for replacing a welded first chain link with a successive, unwelded first chain link on said first chain link supporting means and for replacing a welded second chain link with a successive, unwelded second chain link on said second chain link supporting means subsequent to the respective welding of a first chain link and a second chain link in said sole chain link welding station.

3. A chain welding machine as defined in claim 2, wherein said shifting means includes separate drive means connected to said first and to said second chain link supporting means.

4. A chain welding machine as defined in claim 2, said chain advancing means having first and second chain-advancing clamps supported in the zone of said first and said second chain link supporting means, respectively, for intermittently engaging and advancing said chain; a chain link-grasping jaw forming part of each said clamp; and a jaw drive mechanism for opening and closing the jaws; the improvement further comprising:

d. a drive shaft connected to said first and second clamps;

e. means for rotating said drive shaft for moving said first and second clamps simultaneously parallel to the direction of chain feed; and f. actuating means connected to said jaw drive mechanism, said actuating means being arranged to be operated by said drive shaft in the course of its motion for opening and closing the jaws of the respective first and second clamps.

5. A chain welding machine as defined in claim 2, said first chain link supporting means including a first saddle in the path of advance of the chain for supporting each said first chain link in an edgewise upright orientation for welding; two first ramps disposed immediately adjacent and laterally of the one and the other side of said first saddle, as viewed in the direction of chain advance, for supporting said second links in a flat-lying orientation; said second chain link supporting means including a second saddle in the path of advance of the chain and spaced from said first saddle for supporting each said second chain link in an edgewise upright orientation for welding; two second ramps disposed immediately adjacent and laterally of the one and the other side of said second saddle as viewed in the direction of chain advance, for supporting said first links in a flat-lying orientation; the further improvement wherein said first and second ramps are arranged for vertical displacement with respect to said first and said second saddle, respectively.

6. A chain welding machine as defined in claim 2, said chain advancing means having first and second chain-advancing clamps supported in the zone of said first and said second chain link supporting means, respectively, for intermittently engaging and advancing said chain; the improvement further comprising:

d. separate means for securing said first clamp to said first chain link supporting means and said second clamp to said second chain link supporting means;

e. a drive shaft connected to said first and second clamps; and f. means for rotating said drive shaft for moving said first and second clamps simultaneously parallel to the direction of chain feed.

7. A chain welding machine as defined in claim 6, wherein said separate means pivotally secures said first and second clamps to the respective first and second chain link supporting means.

* * * * *